US006182628B1

(12) United States Patent
Kochs et al.

(10) Patent No.: US 6,182,628 B1
(45) Date of Patent: Feb. 6, 2001

(54) INTEGRATED INLET MANIFOLD/ THROTTLE VALVE CHAMBER UNIT

(75) Inventors: Michael Kochs, Neuss (DE); Jean-Paul Vaudry, Orbey (FR)

(73) Assignee: Mark IV Systemes Moteurs, Paris la Defense (FR)

( * ) Notice: Under 35 U.S.C. 154(b), the term of this patent shall be extended for 0 days.

(21) Appl. No.: 09/395,600

(22) Filed: Sep. 14, 1999

(30) Foreign Application Priority Data

Sep. 14, 1998 (FR) ..... 98 11526

(51) Int. Cl.[7] ..... F02M 35/10
(52) U.S. Cl. ..... 123/184.21; 123/337
(58) Field of Search ..... 123/184.61, 337, 123/184.21; 50/11

(56) References Cited

U.S. PATENT DOCUMENTS 5,158,045 10/1992 Arthur et al. .
5,341,773 * 8/1994 Schulte et al. ..... 123/184.61

FOREIGN PATENT DOCUMENTS 42 29 408 8/1993 (DE) .
196 26 251 1/1998 (DE) .

* cited by examiner

*Primary Examiner*—Noah P. Kamen
(74) *Attorney, Agent, or Firm*—Young & Thompson

(57) ABSTRACT

An inlet manifold/throttle valve chamber unit for a vehicle comprising a heat engine, is characterized in that a module (2) for adjusting the passage cross section is attached in the region of the fresh air feed orifice (3) of an inlet manifold (1) so as to form an integrated inlet manifold/throttle valve chamber unit.

6 Claims, 4 Drawing Sheets

INTEGRATED INLET MANIFOLD/ THROTTLE VALVE CHAMBER UNIT

FIELD OF THE INVENTION

The present invention concerns the field of vehicles with heat engines, more particularly cars, and relates to an integrated inlet manifold/throttle valve chamber unit for vehicles of the aforementioned type.

BACKGROUND OF THE INVENTION

At present, the inlet manifold or air distributor and the throttle valve chamber or choke chamber form two distinct structural entities, the outlet of the throttle valve chamber being connected to the fresh air intake or feed orifice of the inlet manifold by a portion of connecting conduit or tube which also allows, if necessary, the mounting and fixing of said throttle valve chamber.

However, the aforementioned current make-up has various drawbacks which manufacturers and users would like to eliminate.

Thus, the make-up in two structural entities results in considerable bulkiness, in particular in the direction of alignment of the two entities, creates a mechanical weakened zone (connection between the two entities), which may become critical in view of the vibrating environment in particular, creates several dispersed sealing zones subjected to mechanical stresses and necessitates separate management and supply for each of the two entities.

SUMMARY OF THE INVENTION

It is accordingly the object of the present invention to overcome the various aforementioned drawbacks.

To this end, it relates to an inlet manifold/throttle valve chamber unit for a vehicle comprising a heat engine, characterised in that a module for adjusting the passage cross section is attached in the region of the fresh air feed orifice of an inlet manifold so as to form an integrated inlet manifold/throttle valve chamber unit.

BRIEF DESCRIPTION OF THE DRAWINGS

The invention will be understood better by means of the following description which relates to preferred embodiments given as non-limiting examples and explained with reference to the accompanying schematic drawings, in which.

DESCRIPTION OF THE PREFERRED EMBODIMENTS

Figure 1:
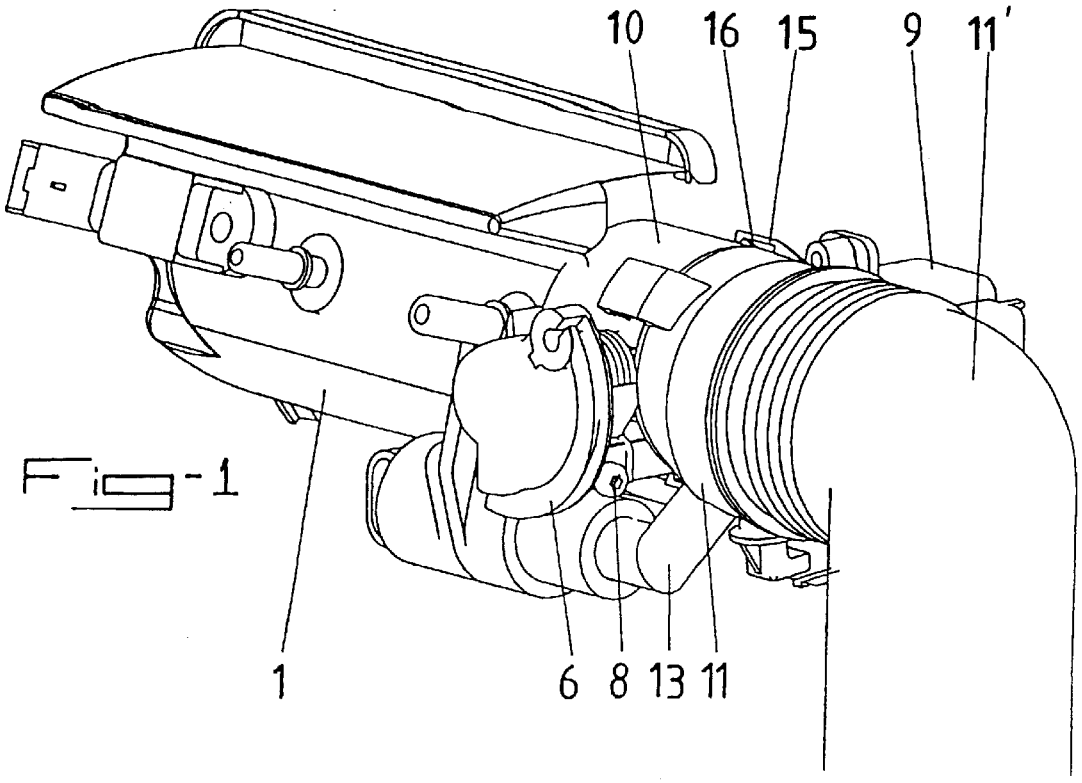
FIG. 1 is a perspective view of an integrated inlet manifold/throttle valve chamber unit according to the invention connected to an air feed conduit.

As shown in FIGS. 1 to 6 of the accompanying drawings, the inlet manifold/throttle valve chamber unit for a vehicle with a heat engine is produced by attaching a module 2 for adjusting the passage cross section in the region of the fresh air feed orifice 3 of the inlet manifold 1 concerned so as to form an integrated inlet manifold/throttle valve chamber unit.

According to a first characteristic of the invention, the adjustment module 2 advantageously consists of an annular body 4 receiving a throttle valve 5 mounted on a pivot shaft 5' connected to means 6, 7, 8, 9 for controlling and checking the rotational position of said shaft 5', which are external to said annular body 4, the annular body 4 being at least partially fitted in a nozzle-shaped extension 10 of the intake manifold 1 in the region of its fresh air feed orifice 3 connected, in particular, to the air filter unit.

The control and checking means can consist, for example, as shown in FIGS. 1 to 3, 5 and 7 of the accompanying drawings, of a control valve or sector 6 mounted stationarily on the pivot shaft 5' and connected, for the driving thereof, to the accelerator pedal, of a restoring spring 7 urging the throttle valve 5 to its position of minimum opening, of a retarding stop 8 defining said position of minimum opening of the throttle valve 5 and of a potentiometer 9 emitting a signal or potential corresponding to the angular rotational value of the throttle valve 5, signal or potential to the computer controlling operation of the engine.

In general, the adjustment module 2 could be controlled mechanically (for example via the control sector 6) or electrically (for example via an electric step-by-step motor).

To produce a progressive variation (proportional or non-proportional) of the flow of air traversing the adjustment module 2 during the opening and closure of the throttle valve 5 by pivoting round its shaft 5', the annular b ody 4 could comprise surplus material or machining of a specific shape in line with said pivot shaft 5'. Furthermore, the throttle valve 5 itself could have an uneven configuration, in particular different thicknesses in cross sections or an uneven periphery, depending on the portion of the throttle valve 5 concerned.

To produce a rigid and sturdy assembly of the adjustment module 2 in and on the inlet manifold 1, said adjustment module 2 is advantageously rotationally locked relative to the inlet manifold 1 by receiving external portions of the pivot shaft 5' or guide bearings 5", of said shaft 5' in opposing cut-outs 10' made in the feed nozzle 10 extending externally from the feed orifice 3, the nesting of the annular body 4 in said feed nozzle 10 being locked and barred by means of an attached ring 11 connected to the body of the inlet manifold 1 or to said feed nozzle 10.

Furthermore, the seal between the annular body 4 of the adjustment module 2 and the body of the inlet manifold 1 is produced by the interposition of a compression joint 12 between an external circumferential offset 4' of the annular body 4 and an internal circumferential offset 10" of the feed nozzle 10, of complementary shape, said joint 12 being compressed during the nesting of said annular body 4 of the adjustment module 2 in said feed nozzle 10.

Figure 4:
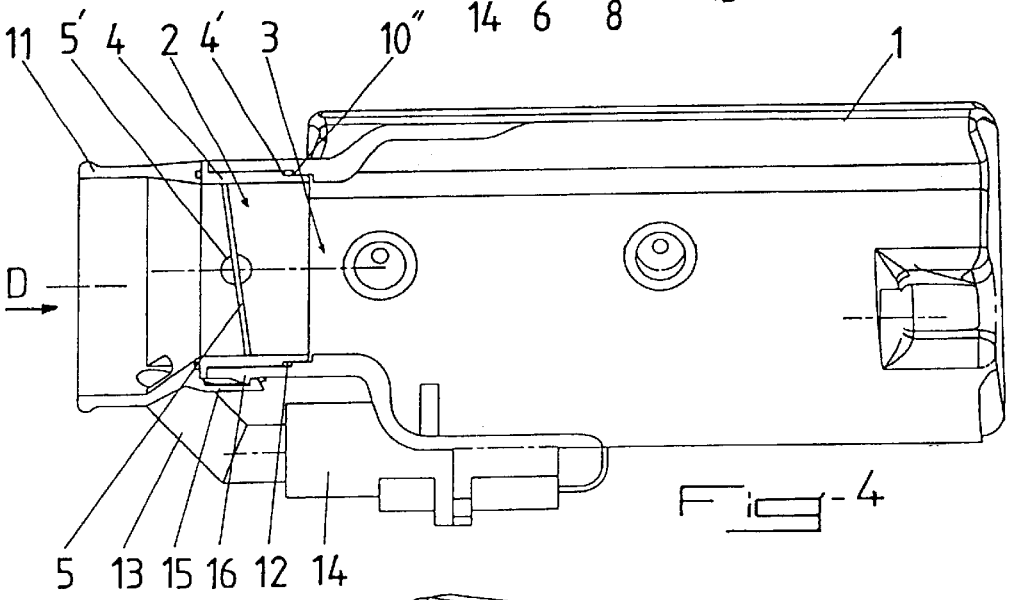
FIG. 4 is a lateral elevation and longitudinal section of the unit shown in FIG. 2.

The locking ring 11 may be connected so as to exert a constant pressure on the annular body 4 in the direction of the nesting, the contacting surface zones of the ring 11 and the body 4 being sealed, for example, by means of an O-ring partially accommodated in a circumferential groove made in the locking ring 11 (see FIG. 4).

The sealing joints, in particular the aforementioned O-ring and the compression joint 12, could consist either of attached independent elements or of parts moulded onto one of the contacting parts (adjustment module or manifold).

According to a variation of the invention shown, in particular, in FIGS. 1 to 6 of the accompanying drawings, the locking ring 11 comprises a tube portion 13 opening in the region of its internal wall and extending outwardly, if necessary formed integrally therewith, said tube portion 13 being designed to be connected to or to receive an additional air valve 14 so as to form a bypass circuit opening into the inlet manifold 1.

Figure 8:
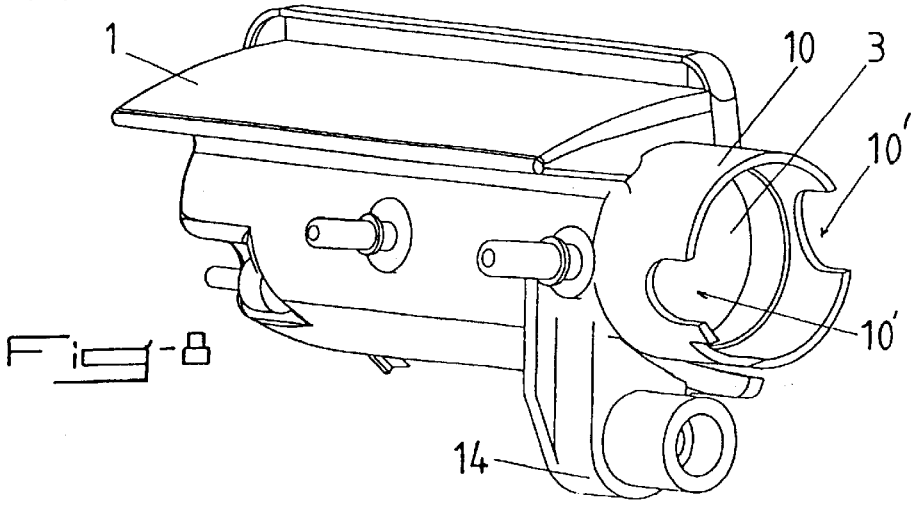
FIG. 8 is a perspective view of an inlet manifold forming part of the unit according to the invention.
Figure 5:
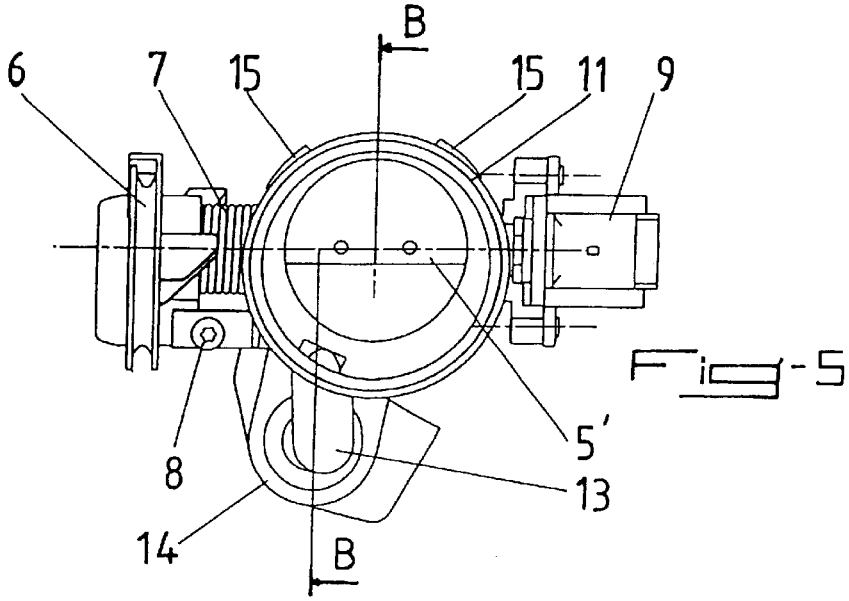
FIG. 5 is a partial front elevation in direction D of the unit shown in FIG. 4.
Figure 6:
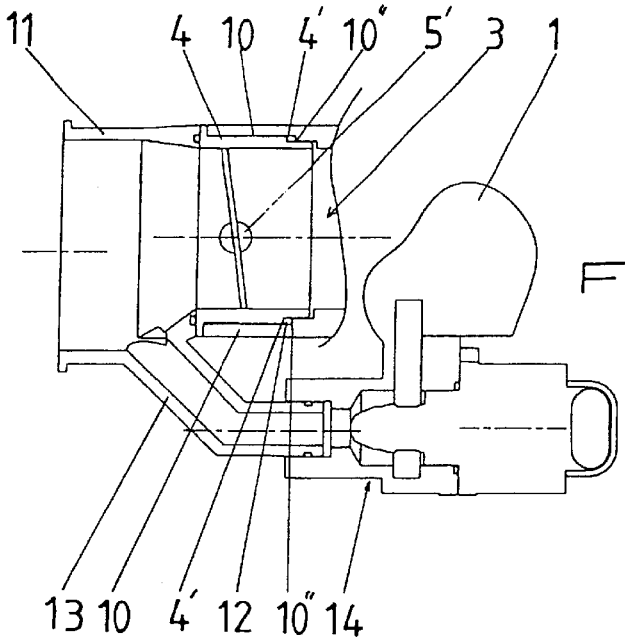
FIG. 6 is a section along A—A of the unit shown in FIG. 5.
Figure 7:
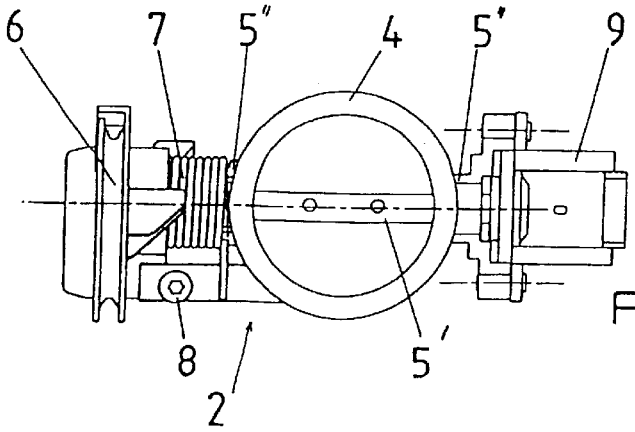
FIG. 7 is a front elevation of an adjustment module forming part of the unit according to the invention.
Figure 9:
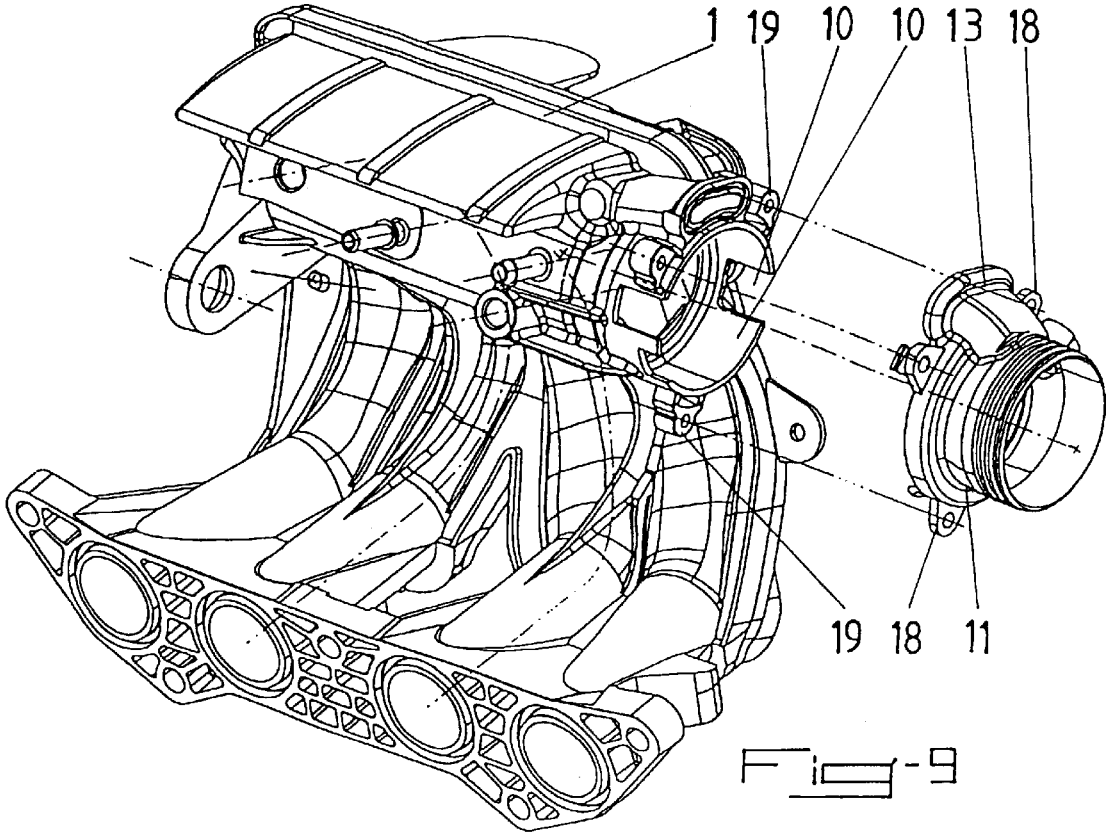
FIG. 9 is a perspective view of the unit according to the invention in a third embodiment.
Figure 10:
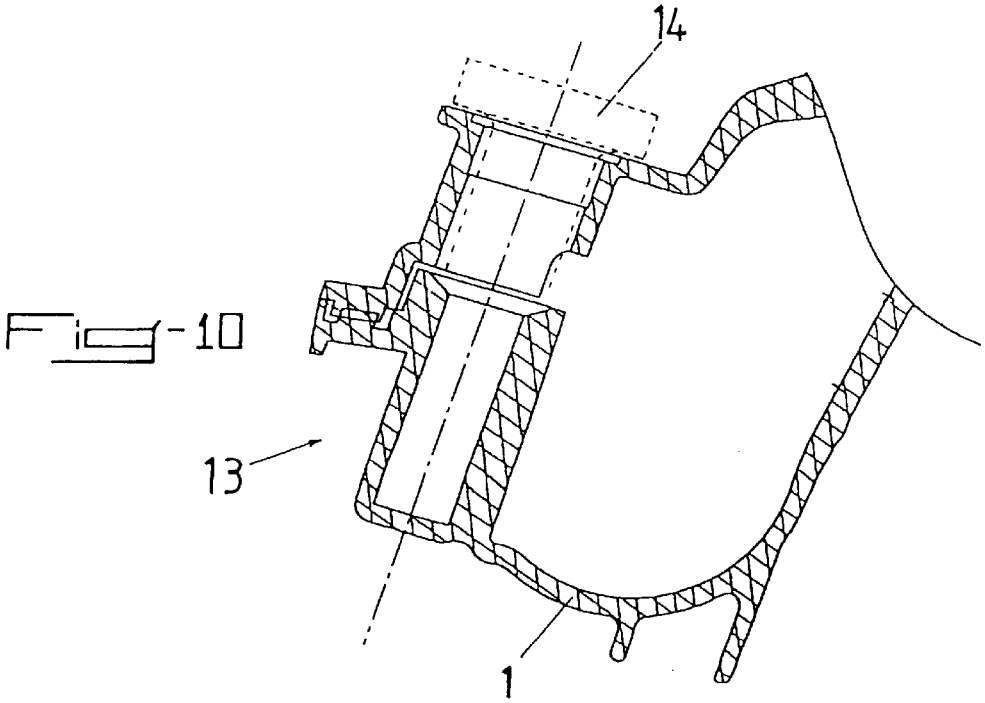
FIG. 10 is a longitudinal section of a portion of a bypass circuit intended to receive an additional air valve (shown in broken lines).

The additional air valve 14 or at least the body thereof, possibly extended by a portion of conduit opening into the inlet manifold 1 could, if necessary, be produced integrally with the inlet manifold 1, which would result in optimum mechanical strength and sealing (FIG. 8 and 9).

The air feed conduit connected to the outlet of the module or of the air filter unit could be mounted on the locking ring 11.

According to an advantageous variation of the invention, however, the locking ring 11 can be extended by an air feed conduit 11' produced integrally with said locking ring 11 so as to form a single part (the locking ring 11 thus constituting the fixing end of the conduit 11') and connected at its opposite end to the outlet of the air filter module (see FIG. 1 of the accompanying drawings).

Figure 2:
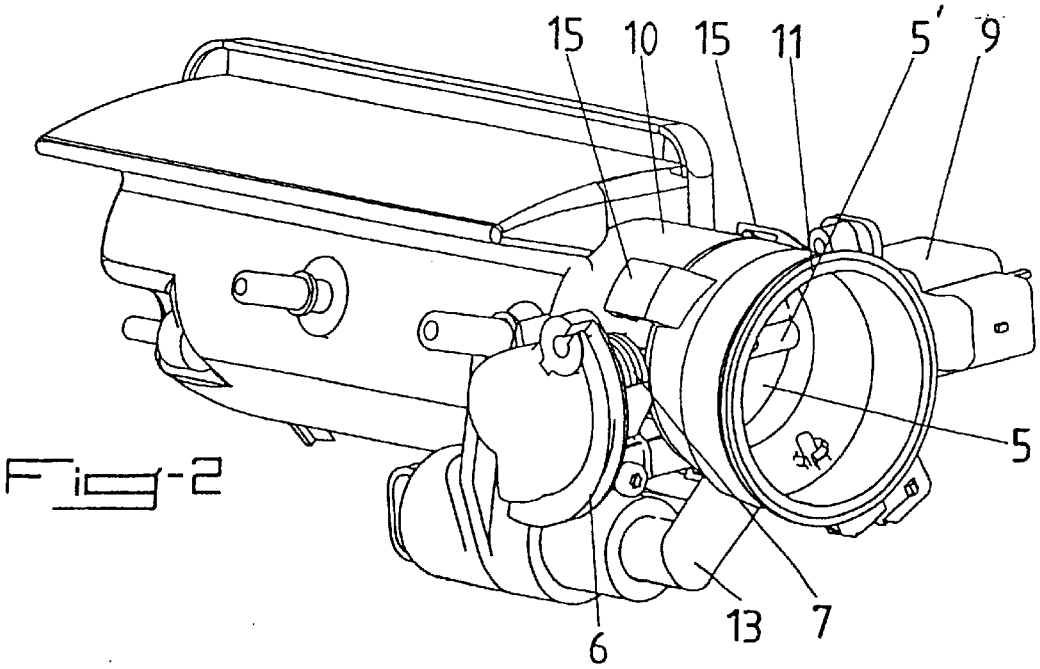
FIG. 2 is a perspective view of the unit according to the invention in a first embodiment.

According to a first embodiment of the invention shown in FIGS. 1, 2 and 4 of the accompanying drawings, the locking ring 11 is connected to the inlet manifold 1 by means of peripheral elastic fastening tabs 15 formed on the locking ring 11 and coming into engagement by catching with corresponding external projecting offsets 16 formed on the feed nozzle 10.

Figure 3:
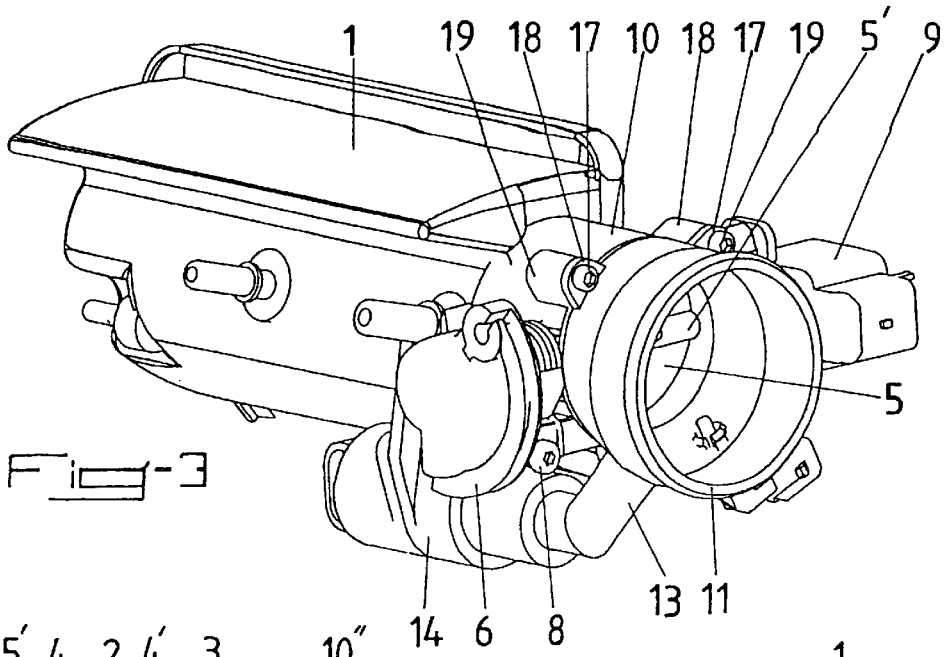
FIG. 3 is a perspective view of the unit according to the invention in a second embodiment.

According to a second embodiment of the invention shown in FIG. 3 of the accompanying drawings, for the mutual connection thereof, the locking ring 11 can be provided with perforated or unperforated lug-shaped peripheral projecting parts 17 and the feed nozzle 10 is equipped with corresponding perforated or unperforated peripheral bosses 18 so as to allow the assembly thereof by self-tapping or non-self-tapping screws 19.

Whereas the inlet manifold 1 is generally produced from a thermoplastic material, the adjustment module 2 could be produced, with regard to its structural parts (in particular the annular body 4), either from thermoplastic or thermosetting material or from aluminum.

The adjustment module as well as the additional air valve will advantageously be positioned in a zone outside the low point in order to avoid the problems associated with condensation and frost.

Owing to the invention, it is therefore possible to produce an inlet manifold/throttle valve chamber unit constituting a compact structural entity which is optimised in terms of seal and mechanical strength.

In fact, the throttle valve chamber is mounted directly in an extension integral with the manifold body without using any connecting means (screws or the like) or fastening means and is thus actually integrated therein and is invisible. It is locked in position by nesting, in the region of its shaft or its rotational bearings, in corresponding cut-outs in said extension while being locked in position by being gripped by a fixing ring.

Thus, the throttle valve chamber is connected to the manifold without being mechanically fixed directly thereon but by locking in position by gripping which also allows a seal to be produced by compression.

Furthermore, the bypass circuit 13, 14 is at least partially formed integrally with the body of the manifold and/or the gripping ring.

In addition, the adjustment module 2 fulfilling the functions of throttle valve chamber has a simplified structure with a limited number of constituent parts, for which the use of materials other than thermoplastic materials may be greatly limited.

Moreover, it is possible to supply a single integrated unit fulfilling the two aforementioned functions (manifold/gas throttle valve), which results in a reduction in the references to be managed and in the assembly time (integration upstream) and facilitated delivery and storage.

The invention is obviously not limited to the embodiments described and illustrated in the accompanying drawings. Modifications are possible, in particular with regard to the constitution of the various elements or by substitution of technical equivalents, without departing from the scope of protection of the invention.

What is claimed is:

1. An integrated inlet manifold/throttle valve chamber unit for a vehicle with a heat engine, the unit comprising:

an inlet manifold having a fresh air feed orifice;

an adjustment module attached to the inlet manifold for adjusting the passage cross section in the region of the fresh air feed orifice;

said adjustment module comprising an annular body receiving a throttle valve mounted on a pivot shaft connected to means for controlling and checking the rotational position of said pivot shaft; said means being external to said annular body;

said annular body nesting at least partially in a nozzle-shaped extension of the intake manifold in the region of the fresh air feed orifice;

said adjustment module being rotationally locked relative to the inlet manifold by receiving at least one of external portions of the pivot shaft and guide bearings of said pivot shaft in opposing cutouts made in the feed nozzle extending from the feed orifice; and the nesting of the annular body in said feed nozzle being locked and barred by a locking ring connected to at least one of the body of the inlet manifold and the feed nozzle.

2. The unit according to claim 1, further comprising a compression joint interpositioned between an external circumferential offset of the annular body and an internal circumferential offset of the feed nozzle of complementary shape for providing a seal between the annular body of the adjustment module and the body of the inlet manifold; said joint being compressed during the nesting of said annular body of the adjustment module in said feed nozzle.

3. The unit according to claim 1, wherein the locking ring comprises a tube portion opening in the region of its internal wall and extending outwardly; said tube portion being structured and arranged to be connected to an additional air valve so as to form a bypass circuit opening into the inlet manifold.

4. The unit according to claim 1, wherein the locking ring comprises an air feed conduit produced integrally with said locking ring.

5. The unit according to claim 1, wherein the locking ring is connected to the inlet manifold by peripheral elastic fastening tabs formed on the locking ring and coming into engagement by catching with corresponding external projecting offsets formed on the feed nozzle.

6. The unit according to claim 1, wherein the locking ring comprises perforated or unperforated lug-shaped peripheral projecting parts, and the feed nozzle comprises corresponding perforated or unperforated peripheral bosses for connecting the locking ring and feed nozzle with screws.

* * * * *